US008952602B2

(12) United States Patent
Nishikawa

(10) Patent No.: US 8,952,602 B2
(45) Date of Patent: Feb. 10, 2015

(54) SPARK PLUG

(71) Applicant: NGK Spark Plug Co., Ltd., Nagoya (JP)

(72) Inventor: Akio Nishikawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/257,442

(22) Filed: Apr. 21, 2014

(65) Prior Publication Data

US 2014/0333195 A1 Nov. 13, 2014

(30) Foreign Application Priority Data

May 9, 2013 (JP) ..... 2013-099209

(51) Int. Cl.
*H01T 13/20* (2006.01)
*H01T 13/32* (2006.01)

(52) U.S. Cl.
CPC ..... *H01T 13/32* (2013.01)
USPC ..... 313/141; 313/145

(58) Field of Classification Search
CPC ..... H01T 13/32; H01T 13/39
USPC ..... 313/118–145
See application file for complete search history.

(56) References Cited

U.S. PATENT DOCUMENTS

2002/0067111 A1* 6/2002 Shibata et al. ..... 313/141
2002/0093277 A1* 7/2002 Hiramatsu ..... 313/141
2004/0239222 A1* 12/2004 Pino et al. ..... 313/141
2005/0029915 A1 2/2005 Yorita et al.

FOREIGN PATENT DOCUMENTS

JP 2002-324650 A 11/2002
JP 2005-56786 A 3/2005

* cited by examiner

*Primary Examiner* — Anne Hines
(74) *Attorney, Agent, or Firm* — Leason Ellis LLP.

(57) ABSTRACT

A spark plug includes a center electrode, an insulator, a metallic shell, and a ground electrode which has a noble metal tip at the other end portion. A gap is formed between a forward end portion of the center electrode and a discharge surface of the noble metal tip. When an acute angle formed by the forward end surface and the discharge surface is θ1, a point on the forward end surface closest to the noble metal tip is A, opposite ends of the discharge surface are B1 and B2, and an angle formed by a first line segment connecting A and B1 and a second line segment connecting A and B2 is θ2, 35°≤θ1≤55°, 85°≤θ2≤90°, and the difference in length between the first and second line segments is equal to or less than 10% of the longer line segment.

6 Claims, 10 Drawing Sheets

SPARK PLUG

This application claims the benefit of Japanese Patent Application No. 2013-099209, filed May 9, 2013, which is incorporated by reference in its entity herein.

FIELD OF THE INVENTION

The present invention relates to a spark plug.

BACKGROUND OF THE INVENTION

Conventionally, there has been known a spark plug in which a noble metal tip is provided at the distal end of a ground electrode, and a spark gap is formed between the noble metal tip and the forward end of a center electrode (see, for example, Japanese Patent Application Laid-Open (kokai) No. 2005-56786 or Japanese Patent Application Laid-Open (kokai) No. 2002-324650).

Problems to be Solved by the Invention

In such a spark plug, as a result of repetition of ignition operation, spark-induced corrosion occurs at the noble metal tip provided at the distal end of the ground electrode. When such spark-induced corrosion progresses at the noble metal tip, the spark gap widens, and misfire occurs, which may lead to deterioration of ignition performance. When the degree of corrosion of the noble metal tip increases as a result of further progress of spark-induced corrosion of the noble metal tip, the spark plug must be replaced. One possible measure for suppressing deterioration of the durability of a spark plug attributable to such spark-induced corrosion is, for example, forming the noble metal tip of the ground electrode to be larger in size. However, even in the case where the noble metal tip of the ground electrode is formed to have a larger size, if spark-induced corrosion of the noble metal tip proceeds nonuniformly, the spark gap widens in a region corresponding to a locally corroded portion of the noble metal tip, and the remaining portion of the noble metal tip remains unused. In such case, there is a possibility that the noble metal tip cannot be used without waste, and the durability of the spark plug cannot be enhanced sufficiently. Also, there has been demand that such a spark plug be configured such that spark is generated efficiently, and when the nucleus of flame is produced as a result of generation of spark, the flame spreads well. Namely, there has been demand that such a spark plug enhance durability and ignition performance simultaneously, to thereby further enhance the performance thereof.

SUMMARY OF THE INVENTION

Means for Solving the Problems

The present invention has been accomplished in order to solve the above-mentioned problems, and can be realized as the following modes.

(1) According to one mode of the present invention, a spark plug is provided. This spark plug comprises a center electrode extending in the direction of an axial line; an insulator disposed around the center electrode such that a forward end portion of the center electrode is exposed; a metallic shell disposed around the insulator; a ground electrode whose one end portion is joined to the metallic shell and which has a noble metal tip at the other end portion thereof, wherein a gap is formed between a forward end portion of the center electrode and a discharge surface of the noble metal tip. The spark plug being characterized in that, on a cross section which passes through the center of the discharge surface and includes the axial line, an acute angle formed by a forward end surface of the center electrode and the discharge surface of the noble metal tip is defined as $\theta 1$, a point on the forward end surface of the center electrode closest to the noble metal tip is defined as a point A, opposite end points of the discharge surface are defined as points B1 and B2, a line segment connecting the point A and the point B1 is defined as a first line segment, a line segment connecting the point A and the point B2 is defined as a second line segment, and an angle formed by the first line segment and the second line segment is defined as $\theta 2$; and, under the above definition, $35° \leq \theta 1 \leq 55°$, $85° \leq \theta 2 \leq 90°$, and a difference in length between the first and the second line segments is equal to or less than 10% of the longer line segment. According to the spark plug of this mode, the above-mentioned three requirements regarding $\theta 1$, $\theta 2$, and the relation between the length of the first line segment and the length of the second line segment are satisfied. Thus, it is possible to suppress the unevenness of spark-induced corrosion of the ground electrode tip, to thereby prevent a portion of the ground electrode tip from being wasted. As a result, the durability of the spark plug can be enhanced (its service life can be increased). Also, the noble metal tip is prevented from hindering spreading of flame, whereby ignition performance can be enhanced.

(2) In the spark plug of the above-described mode, the ground electrode may have a bent portion bent toward the center electrode. According to the spark plug of this mode, a longer distance can be secured between the center electrode and a portion of the ground electrode other than the portion where the noble metal tip is provided. Therefore, it is possible to suppress flying flame (discharge) between the center electrode and a portion of the ground electrode other than the portion where the noble metal tip is provided, to thereby suppress misfire attributable to such flying flame.

(3) In the spark plug of the above-described mode, the noble metal tip may be disposed on a distal end surface of the other end portion. According to the spark plug of this mode, it becomes possible to more easily secure the longer distance between the center electrode and a portion of the ground electrode other than the portion where the noble metal tip is provided. Therefore, it is possible to enhance the effect of suppressing the flying flame (discharge) between the center electrode and a portion of the ground electrode other than the portion where the noble metal tip is provided.

(4) In the spark plug of the above-described mode, when the discharge surface is viewed from a direction perpendicular to the discharge surface, the distal end surface of the ground electrode may be present in at least a portion of a region around the discharge surface. According to the spark plug of this mode, when spark is blown away, the blown spark can be received by the above-mentioned distal end surface. Thus, concentration of spark on the noble metal tip is suppressed, whereby spark-induced corrosion of the noble metal tip and gap increase can be suppressed.

(5) In the spark plug of the above-described mode, when the discharge surface is viewed from the direction perpendicular to the discharge surface, the distal end surface of the ground electrode may be present in at least portions of regions on opposite sides of the discharge surface in a width direction of the ground electrode. According to the spark plug of this mode, there can be enhanced the above-described effect of receiving the blown spark by the above-mentioned distal end surface, to thereby suppress spark-induced corrosion of the noble metal tip and gap increase.

(6) In the spark plug of the above-described mode, when the discharge surface is viewed from the direction perpendicular to the discharge surface, the distal end surface of the ground electrode may be present in the entire regions on opposite sides of the discharge surface in the width direction of the ground electrode. According to the spark plug of this mode, there can be further enhanced the above-described effect of receiving the blown spark by the above-mentioned distal end surface, to thereby suppress spark-induced corrosion of the noble metal tip and gap increase.

The present invention can be realized in other various forms other than the spark plug. For example, the present invention can be realized as a method of manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

[Mode for Carrying out the Invention]

Figure 1:
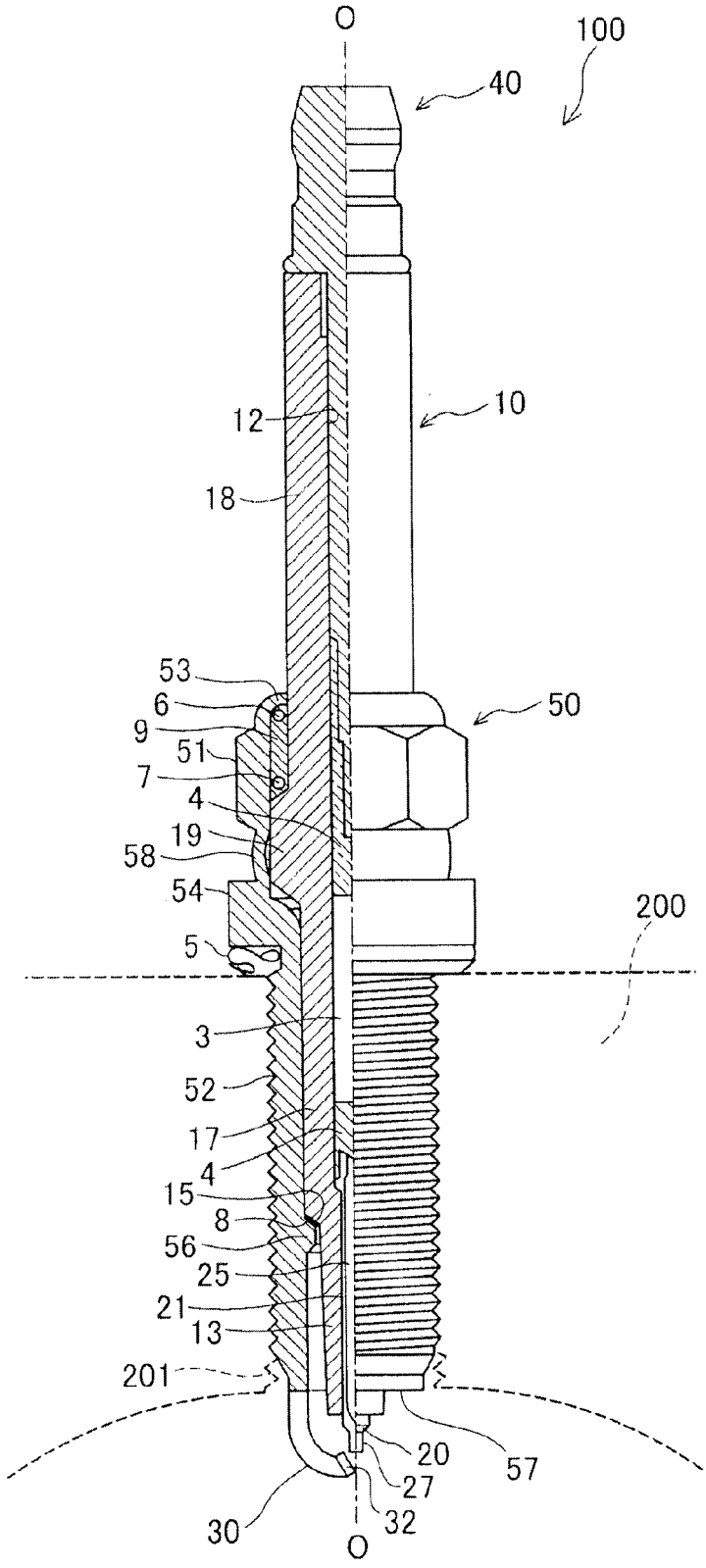
FIG. 1 is a partially sectioned view of a spark plug.

A. First Embodiment:

FIG. 1 is a partially sectioned view of a spark plug 100 which is a first embodiment of the present invention. In FIG. 1, an external shape of the spark plug 100 is shown on the right side of an axial line O, which is the axis of the spark plug 100, and a cross-sectional shape of the spark plug 100 is shown on the left side of the axial line O. In the following description, the lower side of FIG. 1 in a direction parallel to the axial line O will be referred to as the "forward end side," and the upper side of FIG. 1 in the direction will be referred to as the "rear end side."

The spark plug 100 includes a ceramic insulator 10, a center electrode 20, a ground electrode 30, a metallic terminal 40, and a metallic shell 50. The rod-shaped center electrode 20, which projects from one end of the ceramic insulator 10, is electrically connected to the metallic terminal 40 provided at the other end of the ceramic insulator 10, through the interior of the ceramic insulator 10. The outer circumference of the center electrode 20 is held by the ceramic insulator 10, and the outer circumference of the ceramic insulator 10 is held by the metallic shell 50 at a position away from the metallic terminal 40. The ground electrode 30 electrically connected to the metallic shell 50 forms a spark gap (a gap for generating spark) between the ground electrode 30 and the forward end of the center electrode 20. The spark plug 100 is mounted to a mounting screw hole 201 provided in an engine head 200 of an internal combustion engine via the metallic shell 50. When a high voltage of 20,000 V to 30,000 V is applied to the metallic terminal 40, spark is generated at the spark gap formed between the center electrode 20 and the ground electrode 30.

The ceramic insulator 10 is an insulator formed by firing a ceramic material (for example, alumina). The ceramic insulator 10 is a tubular member, and an axial hole 12 for accommodating the center electrode 20 and the metallic terminal 40 is formed at the center thereof. A central trunk portion 19 having an increased outer diameter is formed at the center of the ceramic insulator 10 in the axial direction. A rear trunk portion 18 for providing insulation between the metallic terminal 40 and the metallic shell 50 is formed on the rear end side of the central trunk portion 19. A forward trunk portion 17 having an outer diameter smaller than that of the rear trunk portion 18 is formed on the forward end side of the central trunk portion 19. A leg portion 13 whose outer diameter is smaller than that of the forward trunk portion 17 and decreases toward the forward end side is formed on the forward end side of the forward trunk portion 17.

The metallic shell 50 is a cylindrical tubular metal member which surrounds and holds a portion of the ceramic insulator 10, which portion extends from a portion of the rear trunk portion 18 to the leg portion 13. In the present embodiment, the metallic shell 50 is formed of low-carbon steel. The metallic shell 50 has a tool engagement portion 51, a mounting screw portion 52, and a seal portion 54. A tool (not shown) for mounting the spark plug 100 to the engine head 200 is fitted onto the tool engagement portion 51 of the metallic shell 50. The mounting screw portion 52 of the metallic shell 50 has a screw thread which comes into screw engagement with the mounting screw hole 201 of the engine head 200. The seal portion 54 of the metallic shell 50 is formed in the form of a flange at the rear end of the mounting screw portion 52. An annular gasket 5 is inserted between the seal portion 54 and the engine head 200. A forward end surface 57 of the metallic shell 50 is a circular surface having an opening, and, at the center thereof, the center electrode 20 projects from the leg portion 13 of the ceramic insulator 10.

A crimp portion 53 having a reduced wall thickness is provided on the rear end side of the tool engagement portion 51 of the metallic shell 50. Also, a compression deformation portion 58 which has a reduced wall thickness like the crimp portion 53 is provided between the seal portion 54 and the tool engagement portion 51. Annular ring members 6 and 7 are disposed between a portion of the inner circumferential surface of the metallic shell 50, which portion extends from the tool engagement portion 51 to the crimp portion 53, and the outer circumferential surface of the rear trunk portion 18 of the ceramic insulator 10. Powder of talc 9 is charged between the two ring members 6 and 7. At the time of manufacture of the spark plug 100, crimping work is performed. In the crimping work, the crimp portion 53 is pressed forward such that the crimp portion 53 is bent inward, whereby the compression deformation portion 58 is compressed deformed. As a result of performance of the crimping work, the ceramic insulator 10 is pressed forward within the metallic shell 50 via the ring members 6, 7 and the talc 9. As a result of this pressing, the talc 9 is compressed in the direction of the axial line O, whereby the gastightness of the interior of the metallic shell 50 is enhanced.

Also, on the inner circumference of the metallic shell 50, an insulator step portion 15 located at the base end of the leg portion 13 of the ceramic insulator 10 is pressed, via an annular sheet packing 8, against a metallic shell step portion 56 formed at a position corresponding to the mounting screw portion 52. This sheet packing 8 is a member for maintaining the gastightness between the metallic shell 50 and the ceramic insulator 10, and leakage of combustion gas is prevented.

The center electrode 20 is a rod-shaped member formed by embedding a core material 25 in an electrode base material 21 formed into the shape of a tube with a bottom. The core material 25 is more excellent in thermal conductivity than the electrode base material 21. In the present embodiment, the electrode base material 21 is made of a nickel alloy which contains nickel as a main component, and the core material 25 is made of copper or an alloy which contains copper as a main component. The center electrode 20 is inserted into the axial hole 12 of the ceramic insulator 10 in a state in which the forward end of the electrode base material 21 projects from the axial hole 12 of the ceramic insulator 10, and is electrically connected to the metallic terminal 40 via a ceramic resistor 3 and a seal member 4.

The ground electrode 30 is formed of a metal which is high in corrosion resistance. For example, a nickel alloy is used. The base end of the ground electrode 30 is welded to the forward end surface 57 of the metallic shell 50. A distal end portion of the ground electrode 30 is bent toward the forward end of the center electrode 20.

Figure 2:
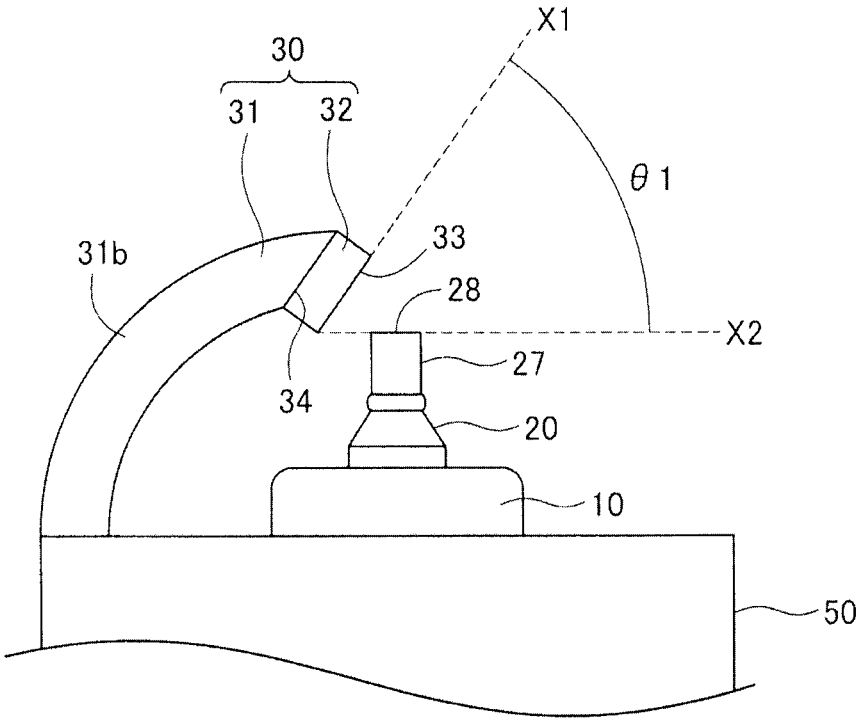
FIG. 2 is an explanatory view showing, on an enlarged scale, the structure of a forward end portion of the spark plug.

FIG. 2 is an explanatory view showing, on an enlarged scale, the structure of a forward end portion of the spark plug 100. In FIG. 2, contrary to FIG. 1, the upper side is the forward end side, and the lower side is the rear end side. As shown in FIG. 2, the ground electrode 30 has a base portion 31 and a ground electrode tip 32. The base portion 31 is a rod-shaped member whose transverse cross section has an approximately rectangular shape. The base portion 31 is curved toward the center electrode 20, and one end thereof is joined to the metallic shell 50. Namely, the base portion 31 of the ground electrode 30 has a bent portion 31*b*, and bends at the bent portion 31*b* toward the center electrode 20 (is bent to have a curved shape). In particular, in the present embodiment, the base portion 31 extends forward along the axial line O from a position where it is connected to the metallic shell 50, and then bends at the bent portion 31*b*. The ground electrode tip 32 is fixed to the other end of the base portion 31 by, for example, laser welding. The other end of the base portion 31 to which the ground electrode tip 32 is fixed forms a distal end surface 34. The distal end surface 34 inclines with resect to a plane perpendicular to the extending direction of the base portion 31; i.e., inclines in a direction for approaching a state in which the distal end surface 34 faces the forward end surface 28 of a center electrode tip 27 in parallel thereto.

The ground electrode tip 32 is a member provided in order to enhance the resistance of the ground electrode 30 to spark-induced corrosion, and is a noble metal tip mainly formed of a noble metal having a high melting point. This ground electrode tip 32 may be formed of, for example, platinum (Pt) or a Pt—Ni alloy. In the present embodiment, the ground electrode tip 32 is formed of a Pt—Ni alloy. A surface (surface which faces the center electrode 20) of the ground electrode tip 32 opposite the surface fixed to the base portion 31 forms a discharge surface 33. In the present embodiment, since the ground electrode tip 32 is formed into an approximately rectangular parallelepiped shape, the discharge surface 33 is approximately parallel to the distal end surface 34 of the base portion 31. Notably, the ground electrode tip 32 corresponds to the "noble metal tip" in claims.

Also, as shown in FIG. 2, the center electrode 20 has the center electrode tip 27 at its forward end. The center electrode tip 27 has the shape of an approximately circular column extending in the direction of the axial line O. In order to enhance the resistance to spark-induced corrosion, the center electrode tip 27 is mainly formed of a noble metal having a high melting point. For example, the center electrode tip 27 may be formed of an iridium (Ir) or an Ir alloy which contains Ir as a main component and to which one or more of platinum (Pt), rhodium (Rh), ruthenium (Ru), palladium (Pd), and rhenium (Re) are added. The forward end surface 28 of the center electrode tip 27 is perpendicular to the direction of the axial line O. Notably, the center electrode tip 27 is not an essential element in the present invention, and the forward end surface of the center electrode 20 will be referred to as the forward end surface 28 irrespective of whether or not the center electrode tip 27 is provided.

FIG. 2 is a cross section which passes through the center of the discharge surface 33 having an approximately rectangular shape and includes the axial line O. In FIG. 2, a straight line which overlaps with the discharge surface 33 on the above-mentioned cross section is shown as a straight line X1, and a straight line which overlaps with the forward end surface 28 on the above-mentioned cross section is shown as a straight line X2. As shown in FIG. 2, on the above-mentioned cross section, the discharge surface 33 of the ground electrode tip 32 and the forward end surface 28 of the center electrode tip 27 form angles. Of the angles, an acute angle will be called θ1.

Figure 3:
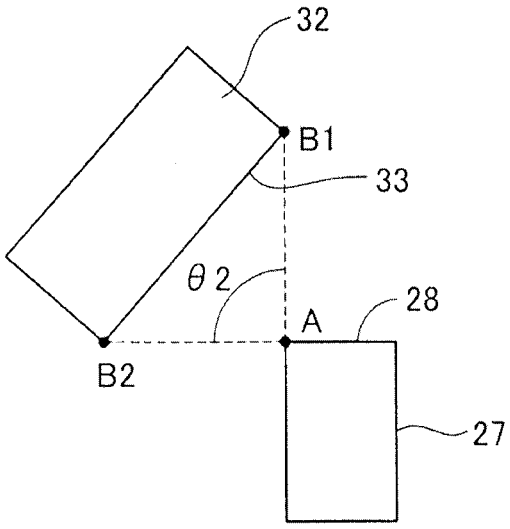
FIG. 3 is an explanatory view showing, on an enlarged scale, the positional relation between a ground electrode tip and a center electrode tip.

FIG. 3 is an explanatory view showing, on an enlarged scale, only the positional relation between the ground electrode tip 32 and the center electrode tip 27 on the same cross section as FIG. 2. On the cross section of FIG. 3, a point on the forward end surface 28 of the center electrode tip 27 closest to the ground electrode tip 32 is defined as point A. Also, on the cross section shown in FIG. 3, opposite end points of the discharge surface 33 of the ground electrode tip 32 are defined as points B1 and B2. A line segment connecting the point A and the point B1 is defined as a first line segment AB1, and a line segment connecting the point A and the point B2 is defined as a second line segment AB2. An angle formed by the first line segment AB1 and the second line segment AB2 will be called θ2.

In the present embodiment, $35° \leq \theta 1 \leq 55°$ stands, and $85° \leq \theta 2 \leq 90°$ stands. Further, in the present embodiment, the difference between the length of the first line segment AB1 and the length of the second line segment AB2 is equal to or less than 10% the length of the longer one of the first line segment AB1 and the second line segment AB2.

According to the spark plug 100 of the present embodiment configured as described above, the above-mentioned three parameters regarding θ1, θ2, and the relation between the length of the first line segment AB1 and the length of the second line segment AB2 are satisfied. Thus, it is possible to suppress the unevenness of spark-induced corrosion of the ground electrode tip 32, to thereby prevent waste of the ground electrode tip 32 in which a portion of the ground electrode tip 32 remains unconsumed. As a result, the durability of the spark plug 100 can be enhanced (its service life can be increased).

In the present embodiment, 35°≤θ1≤55° stands, 85°≤θ2≤90° stands, and the difference between the length of the first line segment AB1 and the length of the second line segment AB2 is equal to or less than 10% the length of the longer line segment. Therefore, a triangle AB1B2 of FIG. 3 is a right-angled isosceles triangle in which the point A is an apex thereof, and the line segment B1B2 is the base thereof, or has a shape similar thereto. Also, in the present embodiment, the above-described three parameters are satisfied. Therefore, the point B1 of the triangle AB1B2 is located on a line extending from the point A in the direction of the axial line O or near the line. The point B2 is located on a line extending from the point A in a direction perpendicular to the axial line O (hereinafter also referred to as the "horizontal direction") or near the line. Discharge between the center electrode tip 27 and the ground electrode tip 32 is likely to occur in a region where the distance between the center electrode tip 27 and the ground electrode tip 32 becomes shorter. Therefore, on the center electrode tip 27, discharge occurs mainly at a corner portion thereof corresponding to the point A, because the triangle AB1B2 has the above-described shape. Since the distance between the ground electrode tip 32 and the point A becomes sufficiently short over the entirety of the discharge surface 33, the entirety of the discharge surface 33 can be utilized for discharge. Accordingly, on the discharge surface 33, formation of a region where the discharge surface 33 is particularly unlikely to be utilized for discharge is suppressed, the unevenness of spark-induced corrosion of the ground electrode tip 32 can be suppressed. Since the speed at which the spark gap widens can be decreased by suppressing the unevenness of spark-induced corrosion in the above-described manner, it is possible to utilize the ground electrode tip 32 without waste, while suppressing misfire, whereby the durability of the spark plug 100 can be enhanced.

Further, according to the present embodiment, the point B1 on the ground electrode tip 32 side is located on the line extending from the point A in the direction of the axial line O or near the line. Therefore, there can be created a state in which the upper side (forward end side in the direction of the axial line O) of the forward end surface 28 of the center electrode tip 27 is not covered by the ground electrode 30 or is hardly covered by the ground electrode 30. Therefore, in the spark plug 100, it becomes easier for flame to spread after generation of spark. Thus, the ignition performance of the spark plug 100 can be enhanced.

Also, in the present embodiment, the ground electrode tip 32 is disposed such that it inclines in relation to the forward end surface 28 of the center electrode tip 27. However, since the ground electrode tip 32 is prevented from existing on the rear end side of a plane extending from the point A in the horizontal direction, it is possible to prevent the discharge surface 33 from having a portion which cannot be utilized for discharge. Therefore, the effect of efficiently utilizing the entirety of the ground electrode tip 32 can be enhanced.

As described above, the smaller the degree of projection of the point B1 toward the center of the center electrode 20 from the line extending from the point A in the direction of the axial line O, the smaller the degree to which growth of flame is hindered. Thus, the ignition performance is enhanced. Also, the smaller the degree of rearward projection of the point B2 from the plane extending from the point A in the horizontal direction, the greater the likelihood that the entirety of the ground electrode tip 32 is utilized. Thus, the unevenness of spark-induced corrosion can be suppressed. In the present embodiment, by defining not only θ1 and θ2 but also the relation between the length of the first line segment AB1 and the length of the second line segment AB2, the above-described positional relation between the point A and the point B1 and the above-described positional relation between the point A and the point B2 are secured.

Figure 4:
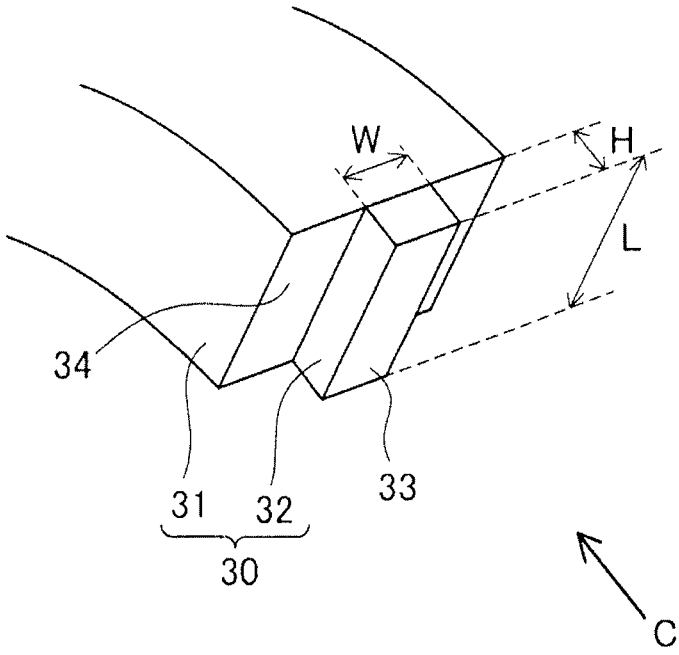
FIG. 4 is a perspective view showing a distal end portion of a ground electrode.
Figure 5:
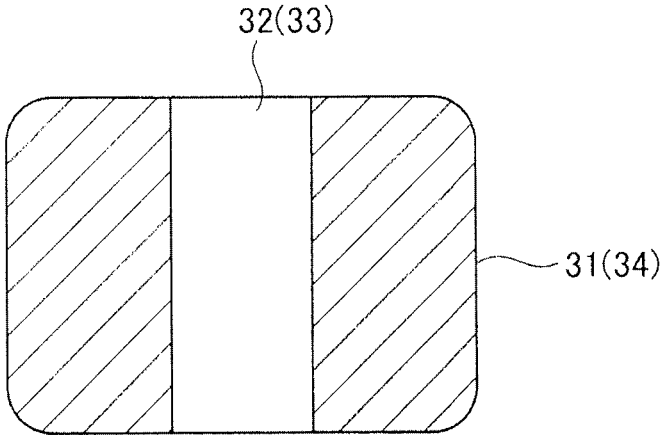
FIG. 5 is a plan view of a discharge surface of the ground electrode tip as viewed from a perpendicular direction.

FIG. 4 is a perspective view showing a distal end portion of the ground electrode 30 of the present embodiment. FIG. 5 is a plan view of the discharge surface 33 of the ground electrode tip 32 as viewed from a direction perpendicular to the discharge surface 33 (the direction of an arrow C shown in FIG. 4). In FIG. 5, the upper side is the forward end side, and the lower side is the rear end side.

As shown in FIGS. 4 and 5, in the present embodiment, the ground electrode tip 32 is attached to the distal end surface 34 of the base portion 31 of the ground electrode 30 to be located about the center of the distal end surface 34. When the discharge surface 33 is viewed from a direction perpendicular to the discharge surface 33, the distal end surface 34 is present in the entire regions on opposite sides of the entire discharge surface 33 in the width direction of the ground electrode 30 (the lateral direction of the discharge surface 33). Namely, over a range from the forward end (the upper end in FIG. 5) to the rear end (the lower end in FIG. 5) of the discharge surface 33 (over the entire length of the discharge surface 33), the distal end surface 34 projects on the opposite sides of the discharge surface 33 in the width direction of the ground electrode 30.

Since the configuration as described above is employed, in the present embodiment, spark-induced corrosion of the ground electrode tip 32 can be suppressed. Namely, when the spark plug operates, the spark generated at the spark gap is blown away by a gas flow within the internal combustion engine. At that time, the blown spark can be received by the base portion 31 of the ground electrode 30 (the projecting portions of the distal end surface 34 shown in FIG. 5, etc.) instead of the ground electrode tip 32. Thus, the spark is prevented from concentrating on the ground electrode tip 32, whereby spark-induced corrosion of the ground electrode tip 32 can be suppressed, and an increase in the spark gap can be suppressed. As a result, the durability of the spark plug 100 can be enhanced. In particular, in the present embodiment, since the distal end surface 34 projects over the region from the upper end to the lower end of the discharge surface 33, the blown spark can be widely received by the base portion 31. As a result, the effect of suppressing spark-induced corrosion of the ground electrode tip 32 can be enhanced.

Notably, the distal end surface 34 may be configured such that, when the discharge surface 33 is viewed from the perpendicular direction, the distal end surface 34 projects only on one side of the discharge surface 33 in the width direction of the ground electrode 30, toward which spark is likely to be blown away. However, it is preferred that, as shown in FIG. 5, the distal end surface 34 projects on the opposite sides of the discharge surface 33 in the width direction of the ground electrode 30. This is for the following reason. The direction of a gas flow in the engine in relation to the spark plug (the direction in which spark is blown away) is determined by the orientation of the ground electrode 30 within the internal combustion engine. It is difficult to adjust the orientation of the spark plug at the time of attachment of the spark plug.

Notably, the spark gap is the distance (shortest distance) between the center electrode tip 27 and the ground electrode tip 32, and, in the present embodiment, the spark gap is the distance between the point A and the discharge surface 33. Although the desirable spark gap changes depending on the applied voltage, it is good to set the spark gap to, for example, 0.4 to 1.2 mm in consideration of the above-described spark-induced corrosion. Also, the thickness (height) of the ground electrode tip 32 may be set to, for example, 0.5 to 1.0 mm. Accordingly, the distance between the point A of the center electrode tip 27 and the distal end surface 34 of the ground electrode 30 may be set to, for example, 0.9 to 2.2 mm. As a result of setting the distance between the point A and the distal end surface 34 such that it falls within the above-described range, the blown spark becomes more likely to be received by the base portion 31, and the effect of suppressing spark-induced corrosion of the ground electrode tip 32 can be enhanced.

Figure 6:
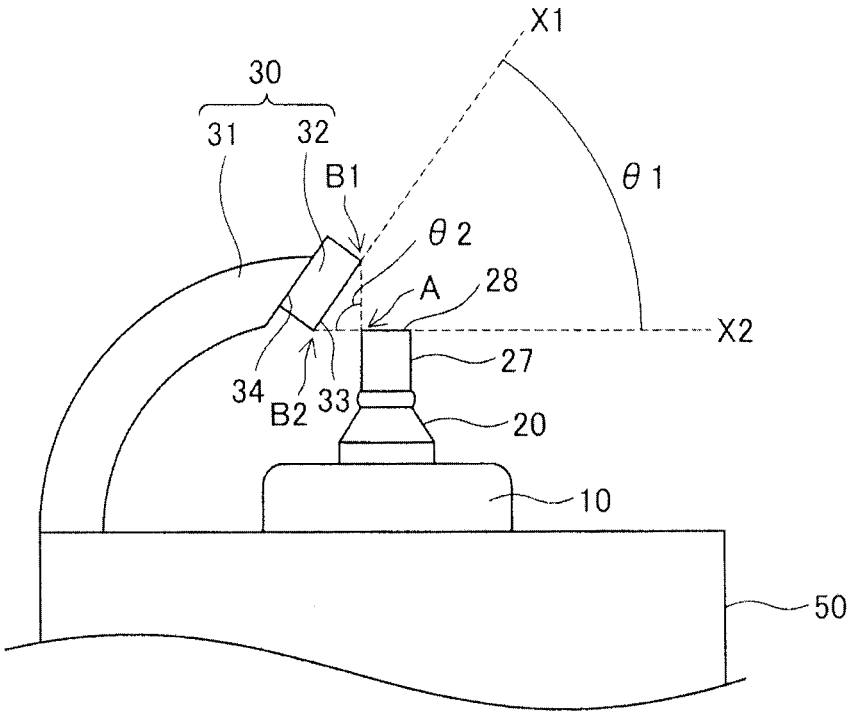
FIG. 6 is an explanatory view showing, on an enlarged scale, the structure of a forward end portion of a spark plug.

B. Second Embodiment:

FIG. 6 is an explanatory view showing a cross section of a forward end portion of a spark plug of a second embodiment, the cross section being similar to FIG. 2. In the second embodiment, portions identical to those of the first embodiment are denoted by the same reference numerals, and their detailed descriptions are omitted.

Figure 7:
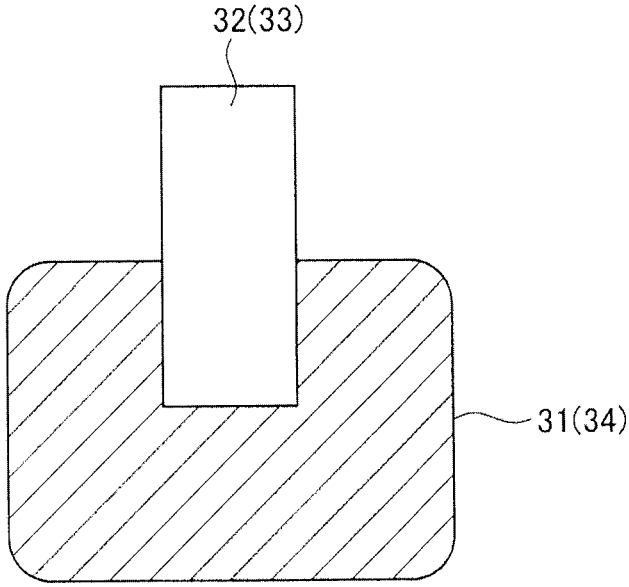
FIG. 7 is a plan view of a discharge surface of the ground electrode tip as viewed from a perpendicular direction.

FIG. 7 is a plan view of the discharge surface 33 of the ground electrode tip 32 of the spark plug of the second embodiment as viewed from a direction perpendicular to the discharge surface 33 as in FIG. 5. Like the first embodiment, the ground electrode tip 32 of the second embodiment is attached to the distal end surface 34 of the base portion 31 of the ground electrode 30 to be located about the center of the distal end surface 34. However, when the discharge surface 33 is viewed from a direction perpendicular to the discharge surface 33, the distal end surface 34 is present in portions of the regions on the opposite sides of the discharge surface 33 in the width direction of the ground electrode 30 (the lateral direction of the discharge surface 33). Specifically, only in a region corresponding to a rear end portion (a lower portion in FIG. 7) of the discharge surface 33, the distal end surface 34 projects on the opposite sides of the discharge surface 33 in the width direction of the ground electrode 30. Notably, in the second embodiment as well, $35° \leq \theta 1 \leq 55°$ stands, and $85° \leq \theta 2 \leq 90°$ stands as in the first embodiment. Further, the difference between the length of the first line segment AB1 and the length of the second line segment AB2 is equal to or less than 10% the length of the longer segment.

As described above, the requirements regarding $\theta 1$, $\theta 2$, and the relation between the length of the first line segment AB1 and the length of the second line segment AB2 are satisfied. Therefore, the spark plug of the second embodiment can enhance ignition performance and durability as in the case of the first embodiment. Also, the effect of suppressing the spark-induced corrosion of the ground electrode tip 32 can be enhanced. Namely, when the spark generated at the spark gap is blown away by a gas flow within the internal combustion engine, the blown spark can be received by the base portion 31 of the ground electrode 30 (the projecting portions of the distal end surface 34 shown in FIG. 7, etc.) instead of the ground electrode tip 32. Thus, the spark is prevented from concentrating on the ground electrode tip 32, whereby spark-induced corrosion of the ground electrode tip 32 can be suppressed, and an increase in the spark gap can be suppressed.

Figure 8:
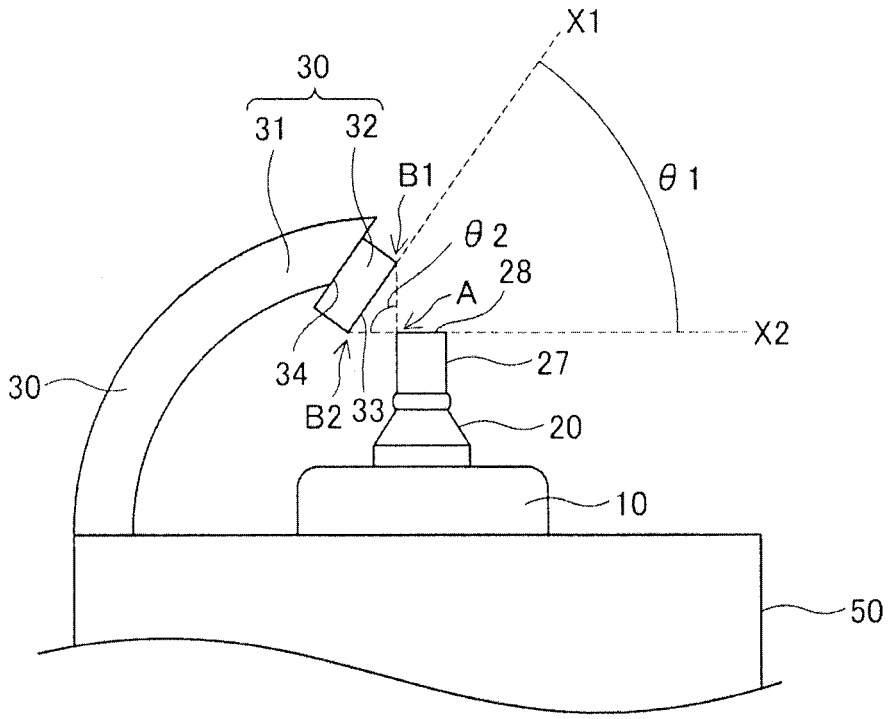
FIG. 8 is an explanatory view showing, on an enlarged scale, the structure of a forward end portion of a spark plug.
Figure 9:
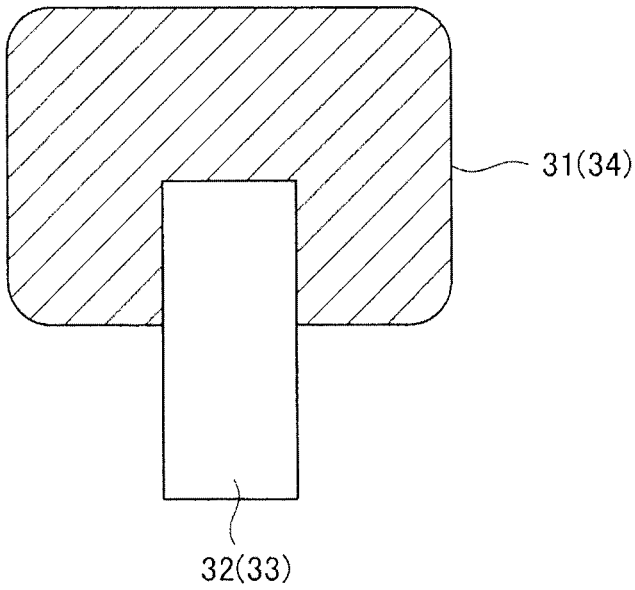
FIG. 9 is a plan view of a discharge surface of the ground electrode tip as viewed from a perpendicular direction.

FIGS. 8 and 9 are explanatory views showing a forward end portion of a spark plug according to a modification of the second embodiment. FIG. 8 shows a cross section similar to that of FIG. 6. FIG. 9 is a plan view of the discharge surface 33 of the ground electrode tip 32 of the spark plug of the second embodiment as viewed from a direction perpendicular to the discharge surface 33 as in FIG. 7. In the present modification of the second embodiment, portions identical to those of the first embodiment are denoted by the same reference numerals, and their detailed descriptions are omitted.

Like the second embodiment, the ground electrode tip 32 of the modification of the second embodiment is attached to the distal end surface 34 of the base portion 31 of the ground electrode 30 to be located about the center of the distal end surface 34, and, when the discharge surface 33 is viewed from a direction perpendicular to the discharge surface 33, the distal end surface 34 is present in portions of the regions on the opposite sides of the discharge surface 33 in the width direction of the ground electrode 30 (the lateral direction of the discharge surface 33). However, in the modification of the second embodiment, only in a region corresponding to a forward end portion (an upper portion in FIG. 9) of the discharge surface 33, the distal end surface 34 projects on the opposite sides of the discharge surface 33 in the width direction of the ground electrode 30. Even when such a configuration is employed, as in the case of the second embodiment, the spark blown by a gas flow within the internal combustion engine can be received by the base portion 31 of the ground electrode 30 (the projecting portions of the distal end surface 34 shown in FIG. 9, etc.) instead of the ground electrode tip 32. Thus, the spark is prevented from concentrating on the ground electrode tip 32, whereby spark-induced corrosion of the ground electrode tip 32 can be suppressed, and an increase in the spark gap can be suppressed.

Notably, in each of the second embodiment and the modification of the second embodiment, it is desired that, when the discharge surface 33 is viewed from the perpendicular direction, the distal end surface 34 projects on the opposite sides of the discharge surface 33 in the width direction of the ground electrode 30, as in the case of the first embodiment.

Notably, as shown in FIGS. 7 and 9, the second embodiment and its modification are configured such that the distal end surface 34 is present only in portions of the regions on the opposite sides of the discharge surface 33 in the width direction of the ground electrode 30. However, from the viewpoint of suppressing spark-induced corrosion attributable to blown spark, it is desired that the distal end surface 34 be present in wider regions on the opposite sides of the discharge surface 33 as in the case of the first embodiment. Also, from the viewpoint of ignition performance, the configuration shown in FIGS. 6 and 7 is more desirable than the configuration shown in FIGS. 8 and 9, because the smaller the degree of presence of the distal end of the ground electrode 30 extending beyond the line which extends from the center electrode 20 (point A) in the direction of the axial line O, the smaller the degree to which spread of flame is hindered.

Figure 10:
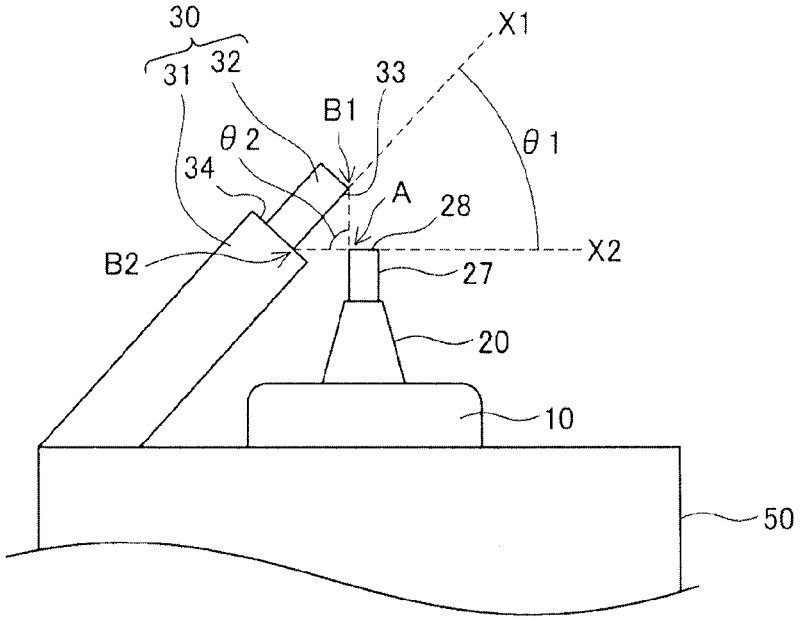
FIG. 10 is an explanatory view showing, on an enlarged scale, the structure of a forward end portion of a spark plug.

C. Third Embodiment:

FIG. 10 is an explanatory view showing a cross section of a forward end portion of a spark plug of a third embodiment, the cross section being similar to FIG. 2. In the third embodiment, portions identical to those of the first embodiment are denoted by the same reference numerals, and their detailed descriptions are omitted.

The third embodiment differs from the first and second embodiments in terms of the positional relation between the base portion 31 and the ground electrode tip 32 in the ground electrode 30. In the third embodiment as well, the ground electrode tip 32 is attached to the distal end surface 34 of the base portion 31 of the ground electrode 30, and the ground electrode tip 32 is formed into an approximately rectangular parallelepiped shape. However, in the third embodiment, a surface of the ground electrode tip 32 having an approximately rectangular columnar shape, the surface being perpendicular to the distal end surface 34 of the base portion 31, serves as the discharge surface 33. Here, of the angles formed by the discharge surface 33 of the ground electrode tip 32 and the forward end surface 28 of the center electrode tip 27, an acute angle is defined as θ1, and the angle formed by the first line segment AB1 and the second line segment AB2 defined as θ2. 35°≤θ1≤55° and 85°≤θ2≤90° stand. Further, the difference between the length of the first line segment AB1 and the length of the second line segment AB2 is equal to or less than 10% the length of the longer segment.

In the spark plug of the third embodiment configured as described above, as in the case of the first embodiment, there is attained an effect of suppressing the unevenness of spark-induced corrosion of the ground electrode tip 32, to thereby enhance durability and ignition performance. However, in the third embodiment, when the discharge surface 33 is viewed from a direction perpendicular to the discharge surface 33, the distal end surface 34 is not present on either of the opposite sides of the discharge surface 33 in the width direction of the ground electrode 30 (the lateral direction of the discharge surface 33). Therefore, the effect of receiving the blown spark by the base portion 31 is inferior to those of the first and second embodiments. Notably, in the third embodiment, the base portion 31 of the ground electrode 30 may have a bent portion which is bent toward the center electrode 20 side to have a curved shape.

Figure 11:
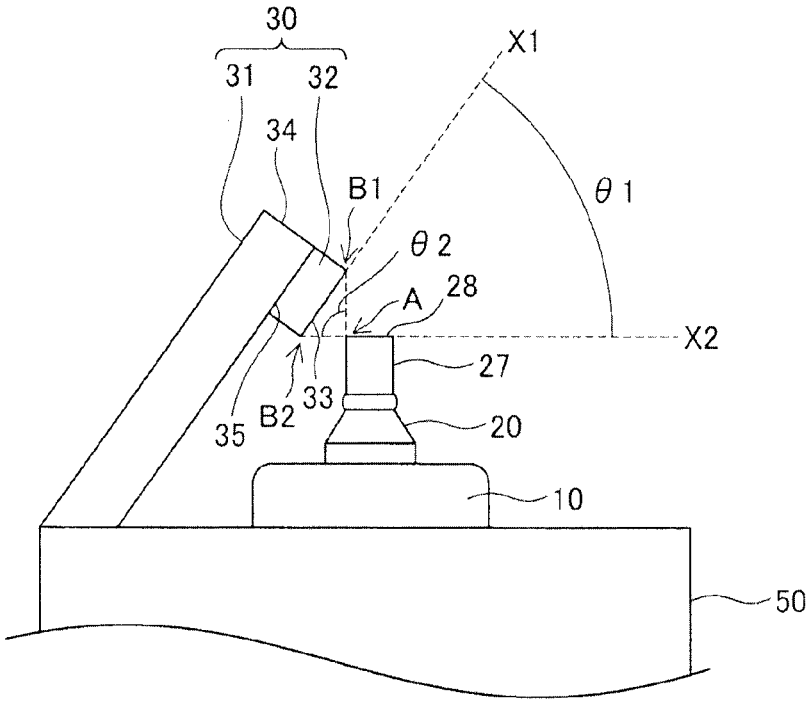
FIG. 11 is an explanatory view showing, on an enlarged scale, the structure of a forward end portion of a spark plug.

D. Fourth Embodiment:

FIG. 11 is an explanatory view showing a cross section of a forward end portion of a spark plug of a fourth embodiment, the cross section being similar to FIG. 2. In the fourth embodiment, portions identical to those of the first embodiment are denoted by the same reference numerals, and their detailed descriptions are omitted.

The fourth embodiment differs from the first through third embodiments in terms of the positional relation between the base portion 31 and the ground electrode tip 32 in the ground electrode 30. In the fourth embodiment, the ground electrode tip 32 is not attached to the distal end surface 34 of the base portion 31 of the ground electrode 30, but is attached to a distal end portion of a side surface 35 of the base portion 31 facing the center electrode tip 27. A surface of the ground electrode tip 32 facing the center electrode tip 27 serves as the discharge surface 33. Also, in the fourth embodiment as well, of the angles formed by the discharge surface 33 of the ground electrode tip 32 and the forward end surface 28 of the center electrode tip 27, an acute angle is defined as θ1, and the angle formed by the first line segment AB1 and the second line segment AB2 is defined as θ2. 35°≤θ1≤55° and 85°≤θ2≤90° stand. Further, the difference between the length of the first line segment AB1 and the length of the second line segment AB2 is equal to or less than 10% the length of the longer segment.

In the spark plug of the fourth embodiment configured as described above, as in the case of the first embodiment, there is attained an effect of suppressing the unevenness of spark-induced corrosion of the ground electrode tip 32, to thereby enhance durability and ignition performance. Notably, in the fourth embodiment, the width of the discharge surface 33 is rendered smaller than that of the base portion 31. Therefore, when the discharge surface 33 is viewed from a direction perpendicular to the discharge surface 33, the side surface 35 is present on the opposite sides of the discharge surface 33 in the width direction of the ground electrode 30 (the lateral direction of the discharge surface 33). Therefore, as in the case of the first and second embodiments, the blown spark is received by the base portion 31. Thus, the effect of suppressing spark-induced corrosion of the ground electrode 32 which is similar to those of the first and second embodiments can be obtained. Also, in the fourth embodiment, the base portion 31 of the ground electrode 30 may have a bent portion which is bent toward the center electrode 20 side to have a curved shape.

As having been already described, in the third embodiment, the ground electrode tip 32 is provided on the distal end surface 34 of the base portion 31, and the surface of the ground electrode tip 32 perpendicular to the distal end surface 34 of the base portion 31 is used as the discharge surface 33. Also, in the fourth embodiment, the ground electrode tip 32 is provided on the side surface 35 of the base portion 31. 35°≤θ1≤55° and 85°≤θ2≤90° stand, and the difference between the length of the first line segment AB1 and the length of the second line segment AB2 is equal to or less than 10% the length of the longer line segment. In such a case, the entire base portion 31 of the ground electrode 30 must be inclined more greatly toward the center electrode 20, as compared with the first and second embodiments in which the distal end surface 34 of the base portion 31 is approximately parallel to the discharge surface 33 of the ground electrode tip 32. Namely, even in the case where a bent portion is provided on the base portion 31 of the ground electrode 30, the distance over which the base portion 31 can be extended along the direction of the axial line O becomes shorter, and the degree of bending toward the center electrode 20 increases. Therefore, in the third and fourth embodiments, as compared with the first and second embodiments, it becomes more difficult to secure the distance between the base portion 31 of the ground electrode 30 and the center electrode tip 27 (the point A) over the entire base portion 31. Therefore, from the viewpoint of suppressing flying of flame between the base portion 31 of the ground electrode 30 and the center electrode tip 27, the first and second embodiments are more preferable than the third and fourth embodiments.

E. Modifications

Modification 1:

In the above-described embodiments, the ground electrode tip 32 has an approximately rectangular parallelepiped shape. However, the ground electrode tip 32 may have a different shape. Effects similar to those of the embodiments can be attained so long as the ground electrode tip 32 has a flat surface serving as the discharge surface 33, and θ1, θ2, and the relation between the length of the first line segment AB1 and the length of the second line segment AB2 satisfy the above-described requirements.

Modification 2:

In the above-described first and second embodiments, when the discharge surface 33 is viewed from a direction perpendicular to the discharge surface 33 of the ground electrode tip 32, the distal end surface 34 of the ground electrode 30 is present at least in portions of the regions on the opposite sides of the discharge surface 33 in the width direction of the ground electrode 30. However, a different configuration may be employed. If, when the discharge surface 33 is viewed from the direction perpendicular to the discharge surface 33, the distal end surface 34 of the ground electrode 30 projects from at least a portion of the perimeter of the discharge surface 33 (in any direction), the same effect achieved by receiving blown spark by the base portion 31 can be obtained.

However, it is more desirable that, as in the first and second embodiments, when the discharge surface 33 is viewed from the direction perpendicular to the discharge surface 33, the distal end surface 34 is present on the opposite sides of the discharge surface 33 in the width direction of the ground electrode 30. This is for the following reason. In the case where the distal end surface 34 is present on the forward end side of the discharge surface 33, the base portion 31 of the ground electrode 30 becomes more likely to cover the upper side of the forward end surface 28 of the center electrode tip 27. Therefore, spreading of flame may be suppressed. Also, in the case where the distal end surface 34 is present on the rear end side of the discharge surface 33, the possibility that the projecting portions of the distal end surface 34 are located on the rear end side of the plane extending from point A in the horizontal direction increases. In such a case, the possibility that blown spark is received by the projecting portions of the distal end surface 34 decreases, and it becomes difficult to sufficiently obtain the effect of preventing spark concentration of the ground electrode tip 32.

EXAMPLES

[Samples 1 to 6]

Figure 12:
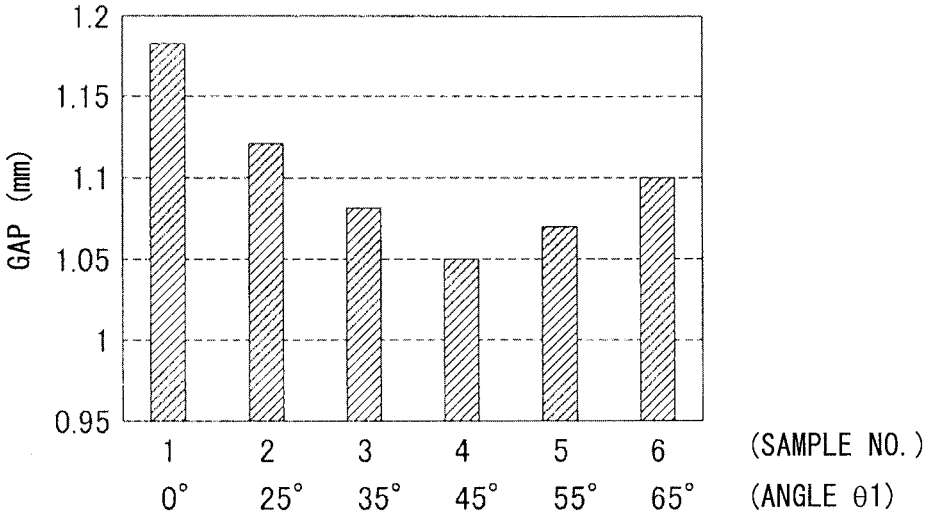
FIG. 12 is an explanatory view showing results of a test for investing the degree of spark-induced corrosion for spark plugs.

FIG. 12 is an explanatory view showing the results of a test in which the degree of spark-induced corrosion was investigated for spark plugs of Samples 1 to 6 differing from one another in terms of the acute angle θ1 formed between the discharge surface 33 of the ground electrode tip 32 and the forward end surface 28 of the center electrode tip 27. θ1 was set to 0° in Sample 1, to 25° in Sample 2, 35° in Sample 3, to 45° in Sample 4, to 55° in Sample 5, and to 65° in Sample 6.

Samples 2 to 6 are spark plugs in which the ground electrode tip 32 is attached to the distal end surface 34 of the base portion 31 of the ground electrode 30 as in the case of the first and second embodiments. On a cross section similar to FIG. 2, the point on the forward end surface 28 of the center electrode 20 closest to the ground electrode tip 32 was defined as a point A, the opposite end points of the discharge surface 33 of the ground electrode tip 32 were defined as points B1 and B2, the angle formed between the first line segment AB1 and the second line segment AB2 was defined as θ2. θ1 was set to the above-described values, with θ2 fixed to 90°. Also, Samples 2 to 6 are the same as the first embodiment shown in FIG. 5 in the point that, when the discharge surface 33 is viewed from the direction perpendicular to the discharge surface 33, the distal end surface 34 is present over the entire regions on the opposite sides of the discharge surface 33 in the width direction of the ground electrode 30 (in the lateral direction of the discharge surface 33).

Figure 13:
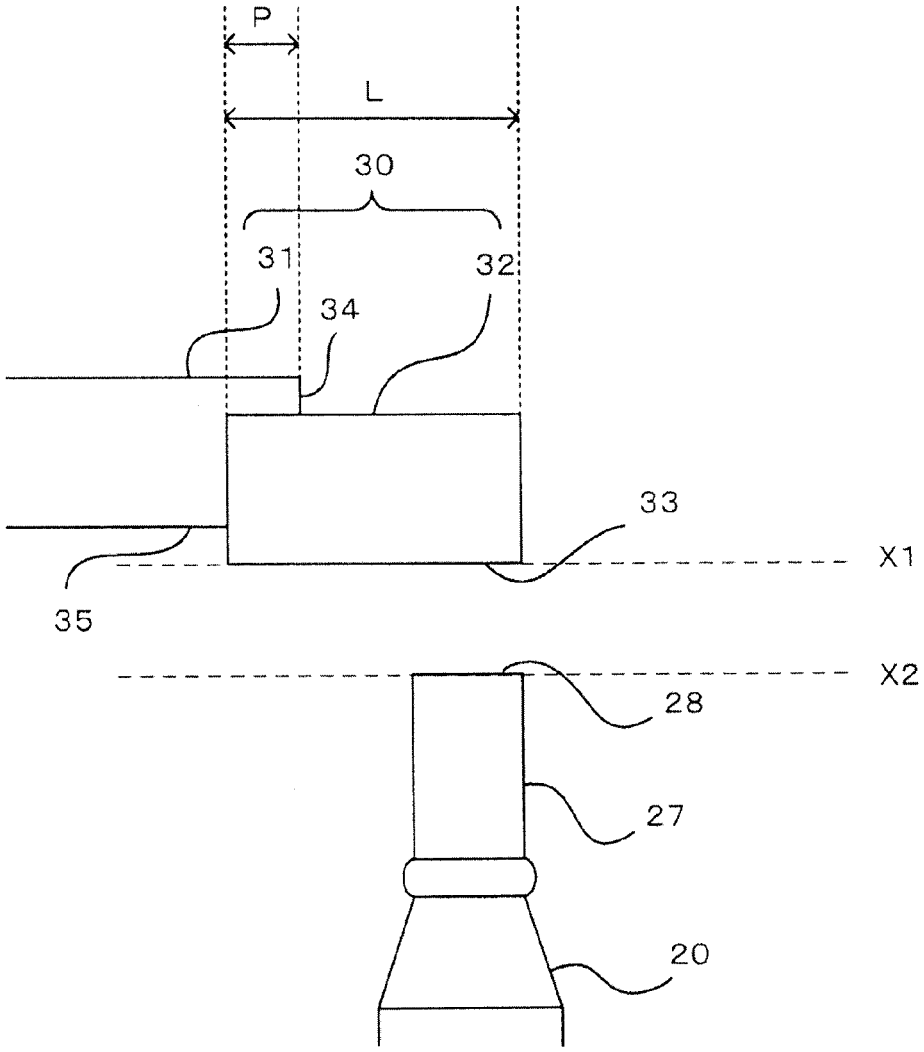
FIG. 13 is an explanatory view showing, on an enlarged scale, the structure of a forward end portion of a spark plug of Sample 1.

FIG. 13 is an explanatory view showing, on an enlarged scale, the structure of a forward end portion of the spark plug of Sample 1. In FIG. 13, portions identical to those of the first embodiment are denoted by the same reference numerals, and their detailed descriptions are omitted. In Sample 1, the ground electrode tip 32 is attached to a part of the base portion 31 of the ground electrode 30, which part includes the corner between the distal end surface 34 and the side surface 35 facing the center electrode tip 27. Also, in Sample 1, θ1=0°; namely, the discharge surface 33 of the ground electrode tip 32 is parallel to the forward end surface 28 of the center electrode tip 27.

Notably, in each sample, the ground electrode tip 32 was formed to have a width W of 0.7 mm, a height H of 0.7 mm, and a length L of 1.4 mm (see FIG. 4). Also, the spark gap (the shortest distance between the discharge surface 33 and the center electrode tip 27 at the time of manufacture) was set to 0.8 mm. Also, the diameter of the center electrode tip 27 was set to 0.55 mm.

Ignition operation was performed by using each of the spark plugs of Samples 1 to 6, and the size of the spark gap after the ignition operation was measured by using a pin gage. The ignition operation was performed under the following conditions.

Atmosphere: nitrogen,
Pressure: 1.65 MPa,
Gas flow rate: 0.15 L/min,
Frequency: 100 Hz,
Time: 25 hours.

As shown in FIG. 12, it was confirmed that an increase in the spark gap can be suppressed by setting θ1 to an angle of 35° to 55°. The fact that the spark gap increases more greatly upon performance of the ignition operation under the same conditions means that conceivably, spark-induced corrosion progressed in a more limited region. Accordingly, it is considered that the unevenness of spark-induced corrosion can be suppressed by setting θ1 to an angle of 35° to 55°.

[Samples 7 to 10]

Figure 14:
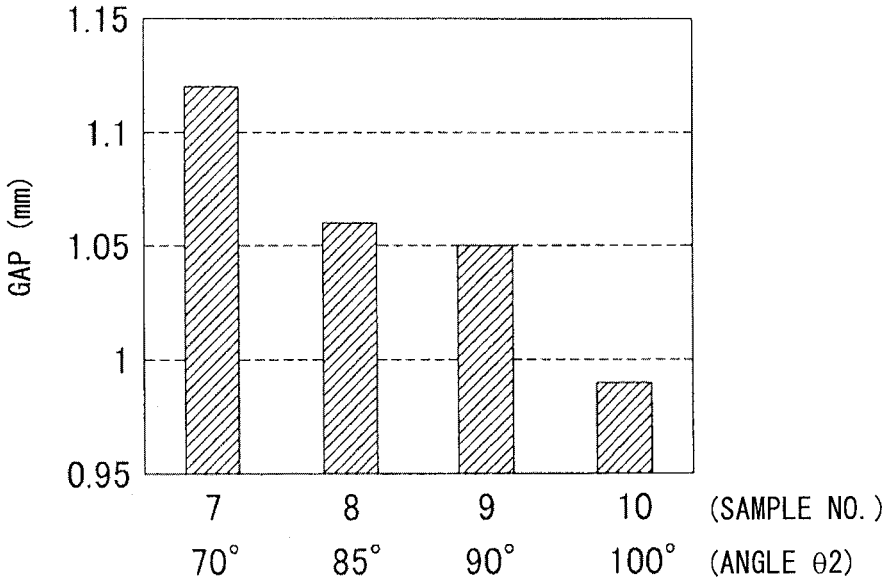
FIG. 14 is an explanatory view showing results of a test for investing the degree of spark-induced corrosion for spark plugs.

FIG. 14 is an explanatory view showing the results of a test in which the degree of spark-induced corrosion was investigated for spark plugs of Samples 7 to 10. Specifically, on a cross section similar to FIGS. 2 and 3, the point on the forward end surface 28 of the center electrode 20 closest to the ground electrode tip 32 was defined as a point A, the opposite end points of the discharge surface 33 of the ground electrode tip 32 were defined as points B1 and B2, the angle formed between the first line segment AB1 and the second line segment AB2 was defined as θ2. The value of θ2 was changed among the samples. θ2 was set to 70° in Sample 7, to 85° in Sample 8, 90° in Sample 9, and to 100° in Sample 10.

Samples 7 to 10 are spark plugs in which the ground electrode tip 32 is attached to the distal end surface 34 of the base portion 31 of the ground electrode 30 as in the case of the first and second embodiments. The length of the first line segment AB1 was made equal to the length of the second line segment AB2, and θ2 was set to the above-described values. Also, Samples 7 to 10 are the same as the first embodiment shown in FIG. 5 in the point that, when the discharge surface 33 is viewed from the direction perpendicular to the discharge surface 33, the distal end surface 34 is present over the entire regions on the opposite sides of the discharge surface 33 in the width direction of the ground electrode 30 (in the lateral direction of the discharge surface 33). The sizes (shapes) of the ground electrode tip 32 and the center electrode tip 27 are the same as Samples 1 to 6. In each of Samples 7 to 10, the spark gap (the shortest distance between the discharge surface 33 and the center electrode tip 27 at the time of manufacture) was set to 0.8 mm.

Ignition operation was performed by using each of the spark plugs of Samples 7 to 10, and the size of the spark gap after the ignition operation was measured by using a pin gage. The ignition operation was performed under the same conditions as those described for Samples 1 to 6.

As shown in FIG. 14, the greater the value of θ2, the greater the degree to which an increase in the spark gap was suppressed. This is for the following reason. Since the area of the discharge surface 33 of the ground electrode tip 32 increases with θ2, spark-induced corrosion can progress while spreading in a wider region, whereby an increase in the spark gap is suppressed.

Figure 15:
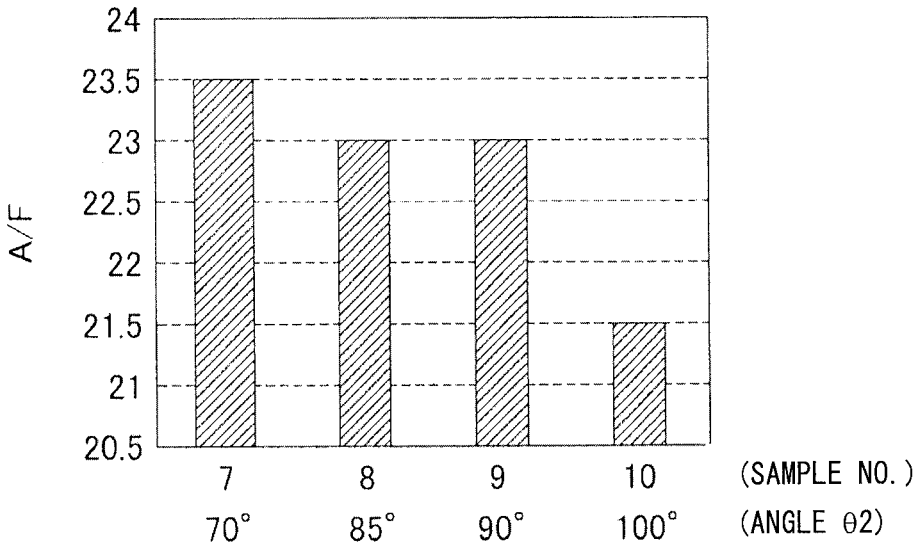
FIG. 15 is an explanatory view showing results of a test for investing the ignition performances of spark plugs.

FIG. 15 is an explanatory view showing the results of a test in which the air-fuel mixture ignition performances of the spark plugs of Samples 7 to 10 were investigated. The ignition performance was investigated by obtaining a measurement value according to a lean limit method. The "measurement value according to a lean limit method" is a value obtained as a limit value of the air-fuel ratio at which ignition of an air-fuel mixture becomes impossible when the degree of leanness of fuel in relation to air in the air-fuel mixture is increased. Hereinafter, this value will be referred to as a "limit air-fuel ratio." Notably, the "air-fuel ratio" is a value (A/F) obtained by dividing the mass of air contained in the air-fuel mixture by the mass of fuel contained in the air-fuel mixture. The higher the limit air-fuel ratio, the greater the degree to which the air-fuel mixture ignition performance of the spark plug is enhanced. FIG. 15 shows the limit air-fuel ratio of each sample.

Specifically, the limit air-fuel ratio was obtained as follows. Each of the spark plugs of Samples 7 to 10 was mounted to an engine and caused to perform ignition operation. The air fuel ration (A/F) was changed, and determination as to whether misfire occurred was made on the basis of the torque of the engine. The air-fuel ratio at the time when the misfire percentage became 10% or higher was obtained as the limit air-fuel ratio. Notably, in this test, there was used a combustion chamber applied to an automotive internal combustion engine having a displacement of 1500 cc. The limit air-fuel ratio was obtained under the following conditions.

Engine: 1.5 L DOHC 4 valves,
Engine speed: 1600 rpm,
Net mean effective pressure (NMEP): 340 kPa,
Ignition timing: Igt60°BTDC.

As shown in FIG. 15, there was confirmed a tendency that the greater the angle θ2, the greater the chance of occurrence of misfire. This is for the following reason. Conceivably, when the angle θ2 increases, the degree of covering of the upper side (the forward end side in the direction of the axial line O) of the forward end surface 28 of the center electrode tip 27 by the ground electrode 30 increases, whereby growth of flame is suppressed.

The above-described results shown in FIGS. 14 and 15 demonstrate that θ2 is desirably set to an angle of 85° to 90° from the viewpoint of the balance between spark-induced corrosion (the degree of increase in spark gap) and ignition performance.

[Samples 11 to 13]

Figure 16:
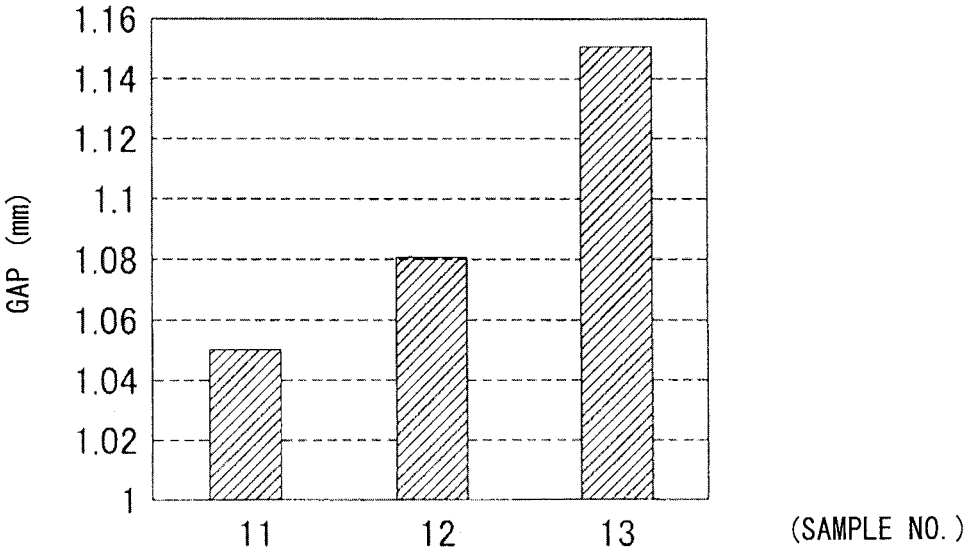
FIG. 16 is an explanatory view showing results of a test for investing the degree of spark-induced corrosion for spark plugs.

FIG. 16 is an explanatory view showing the results of a test in which the degree of spark-induced corrosion was investigated for spark plugs of Samples 11 to 13. Sample 11 is a spark plug having the same shape as the first embodiment shown in FIGS. 2 to 5. Sample 12 is a spark plug having the same shape as the second embodiment shown in FIGS. 6 and 7. Sample 13 is a spark plug having the same shape as the third embodiment shown in FIG. 10. Notably, the sizes (shapes) of the ground electrode tip 32 and the center electrode tip 27 are the same as Samples 1 to 6. In each of Samples 11 to 13, the spark gap (the shortest distance between the discharge surface 33 and the center electrode tip 27 at the time of manufacture) was set to 0.8 mm.

Ignition operation was performed by using each of the spark plugs of Samples 11 to 13, and the size of the spark gap after the ignition operation was measured by using a pin gage. The ignition operation was performed under the same conditions as those described for Samples 1 to 6.

As shown in FIG. 16, an increase in the spark gap was suppressed to the greatest degree in Sample 11. The spark gap increased to the greatest degree in Sample 13. Namely, it was confirmed that the greater the degree of presence of the distal end surface 34, the greater the degree to which an increase in the spark gap was suppressed. The degree of presence of the distal end surface 34 means the degree of present (projection) of the distal end surface 34 on the opposite sides of the discharge surface 33 in the width direction of the ground electrode 30 when the discharge surface 33 of the ground electrode tip 32 is viewed in the direction perpendicular to the discharge surface 33.

The present invention is not limited to the above-described embodiments, examples, and modifications, and can be realized in various configurations without departing from the scope of the invention. For example, the technical features in the embodiments, examples, and modifications which correspond to the technical features in the modes described in the "Summary of the Invention" section may be freely combined or be replaced with other technical features so as to solve some or all of the above-mentioned problems or to achieve some or all of the above-mentioned effects. Also, those technical features which are not described in the present specification as essential technical features may be freely omitted.

DESCRIPTION OF SYMBOLS

3 . . . ceramic resistor
4 . . . seal member
5 . . . gasket
6 . . . ring member
8 . . . sheet packing
9 . . . talc
10 . . . ceramic insulator
12 . . . axial hole
13 . . . leg portion
15 . . . insulator step portion
17 . . . forward trunk portion
18 . . . rear trunk portion
19 . . . central trunk portion
20 . . . center electrode
21 . . . electrode base material
25 . . . core material
27 . . . center electrode tip
28 . . . forward end surface
30 . . . ground electrode
31 . . . base portion
31*b* . . . bent portion
32 . . . ground electrode tip
33 . . . discharge surface
34 . . . distal end surface
35 . . . side surface
40 . . . metallic terminal
50 . . . metallic shell
51 . . . tool engagement portion
52 . . . mounting screw portion
53 . . . crimp portion
54 . . . seal portion
56 . . . metallic shell step portion
57 . . . forward end surface
58 . . . compression deformation portion
100 . . . spark plug
200 . . . engine head
201 . . . mounting screw hole

What is claimed is:

1. A spark plug comprising:

a center electrode extending in the direction of an axial line;

an insulator disposed around the center electrode such that a forward end portion of the center electrode is exposed;

a metallic shell disposed around the insulator; and a ground electrode whose one end portion is joined to the metallic shell and which has a noble metal tip at the other end portion thereof, wherein a gap is formed between a forward end portion of the center electrode and a discharge surface of the noble metal tip, and wherein on a cross section which passes through the center of the discharge surface and includes the axial line, an acute angle formed by a forward end surface of the center electrode and the discharge surface of the noble metal tip is defined as $\theta 1$, a point on the forward end surface of the center electrode closest to the noble metal tip is defined as a point A, opposite end points of the discharge surface are defined as points B1 and B2, a line segment connecting the point A and the point B1 is defined as a first line segment, a line segment connecting the point A and the point B2 is defined as a second line segment, and an angle formed by the first line segment and the second line segment is defined as $\theta 2$; and under the above definitions, $35° \leq \theta 1 \leq 55°$, $85° \leq \theta 2 \leq 90°$, and a difference in length between the first and second line segments is equal to or less than 10% of the length of a longer line segment.

2. The spark plug according to claim 1, wherein the ground electrode has a bent portion bent toward the center electrode.

3. The spark plug according to claim 2, wherein the noble metal tip is disposed on a distal end surface of the other end portion.

4. The spark plug according to claim 3, wherein, when the discharge surface is viewed from a direction perpendicular to the discharge surface, the distal end surface of the ground electrode is located on at least a portion of a region around the discharge surface.

5. The spark plug according to claim 4, wherein, when the discharge surface is viewed from the direction perpendicular to the discharge surface, the distal end surface of the ground electrode is located at least on one side portion of two side portions provided next to the discharge surface in a width direction of the ground electrode.

6. The spark plug according to claim 5, wherein, when the discharge surface is viewed from the direction perpendicular to the discharge surface, the distal end surface of the ground electrode is located on entire two side portions of the discharge surface in the width direction of the ground electrode.

* * * * *